US005092588A

United States Patent [19]

DeLuca

[11] Patent Number: 5,092,588

[45] Date of Patent: Mar. 3, 1992

[54] EXERCISE APPARATUS

[76] Inventor: Alfonse J. DeLuca, 2024 State Hwy. #88, Brick Town, N.J. 08723

[21] Appl. No.: 569,654

[22] Filed: Aug. 20, 1990

[51] Int. Cl.[5] ..... A63B 21/06

[52] U.S. Cl. ..... 272/116; 272/124; 272/67

[58] Field of Search ..... 272/124, 116, 106, 100, 272/67, 78, 117, 122, 143; 273/26 B, 1.5 R, 1.5 A, 26 D; 81/120

[56] References Cited

U.S. PATENT DOCUMENTS

| | | | |
|---|---|---|---|
| 263,887 | 9/1882 | Folk | 272/124 |
| 1,658,108 | 2/1928 | Vaughn | 272/67 |
| 3,874,660 | 4/1975 | Brether | 272/124 |
| 4,664,373 | 5/1987 | Hait | 272/117 |
| 4,974,836 | 12/1990 | Hirsh | 272/900 |

OTHER PUBLICATIONS

Swingrite, Engineering Assoc. 1154-11th Ave, Green Bay, Wisc. 54304.

*Primary Examiner*—Richard J. Apley
*Assistant Examiner*—Jerome Donnelly
*Attorney, Agent, or Firm*—Clifford G. Frayne

[57] ABSTRACT

An exercise apparatus particularly for baseball pitchers for strengthening the pitching arm, the apparatus having a standard, regulation baseball axially secured to a shaft, the opposing end of the shaft having a weighted resistance, the baseball selectively rotatable on the shaft to permit the gripping of the baseball for adapting to different pitching grips, the user gripping the baseball and using a hammer-like action to engage the weighted resistance against a frictionally displaceable resistance such as a dowel or nail.

4 Claims, 4 Drawing Sheets

EXERCISE APPARATUS

FIELD OF THE INVENTION

The present invention relates to an exercise apparatus and, in particular, to an apparatus specifically designed for baseball pitchers to strengthen the muscles in the fingers, wrist, forearm and shoulder during the off-season and during rehabilitation periods and to toughen the skin and callouses of the fingers.

BACKGROUND OF THE INVENTION

Baseball pitchers, be they right-handed or left-handed, must strengthen the muscles of their fingers, wrist, forearms and shoulder in order to develop an effective pitching motion which will withstand the rigors of a baseball season. Typically, this muscle strengthening occurs in spring training where the pitchers gradually develop their pitching motion and velocity over the course of several weeks of practice outdoors. Pitchers on a professional level may have the ability to access training facilities which allow for indoor pitching during the off-season in inclement weather, such facilities are not generally available to amature pitchers of all ages.

Additionally, despite this gradual development of the throwing motion during spring training, a pitcher often times experiences an injury during the season which requires several weeks of layoff and then the gradual resumption of the throwing motion to regain form and velocity.

Further, the pitching motion is unique in all sports in that the pitcher grips the baseball which is a solid sphere having a stitched pattern and must throw this baseball on the average of 100 times per game at the required velocity while imposing a certain spin on the ball to achieve the desired pitch. This spin is achieved through the action of the fingers and wrist of the pitcher. As a consequence, the fingers of the gripping hand are toughened and develop callouses which permit the pitcher to perform the pitches which he desires to throw. A layoff during the off-season or an injury during the season which prevents the pitcher from normal practice or competition results in the rapid deterioration of these calloused areas on the fingers which again requires a rehabilitative period before the pitcher returns to form.

There are many excercise devices on the market which allow athletes to strengthen and maintain muscle tone during the off-season and during the active season. These exercise devices can range from free weights to complex exercise devices involving weights, pulleys and chains. While these exercise devices serve the purpose of exercising the general muscular framework of the body, no such device has thus far been developed specifically for baseball pitchers which permits the baseball pitcher to exercise, develop, and in some cases, rehabilitate the fingers, wrist and forearms of the pitching arm. The present apparatus is directed specifically to this type of training and can be utilized by the pitcher for exercise in the off-season or for the rehabilitative exercise and can be utilized without the necessity for a large room or space for throwing the baseball.

OBJECTS OF THE INVENTION

It is an object of the present invention to provide for a novel exercise device for baseball pitchers which incorporates an actual baseball and resistance and permits the strengthening of the fingers, wrist, forearm and shoulder without the necessity of releasing the baseball from the grip. It is a further object of the present invention to provide for a novel apparatus for baseball pitchers, which permits the baseball pitcher to strengthen the fingers, wrist, forearm and shoulder by gripping an actual baseball and working against resistance and permitting the pitcher to grip the baseball in the variety of grips required for pitching different types of pitches.

It is a still further object of the present invention to provide for a novel exercise apparatus for baseball pitchers which can be used for training or rehabilitative purposes in an enclosed area thereby negating the need for large practice areas.

SUMMARY OF THE INVENTION

An exercise apparatus particularly for baseball pitchers for strengthening the fingers, wrist, forearm and shoulder to improve the pitching arm motion, the apparatus having a standard baseball axially secured to a shaft, at one end, the opposing end having a resistance in the form of a weight, the baseball selectively rotatable on the shaft to permit the gripping of the baseball for adapting to different pitches, the user gripping the baseball and using a hammer-like action to engage the resistance in the form of a weight, against a frictionally-displaceable dowel or nail.

BRIEF DESCRIPTION OF THE DRAWINGS

The objects and advantages of the invention as well as other objects and advantages will become evident upon consideration of the drawings wherein.

DETAILED DESCRIPTION OF THE DRAWINGS

Figure 1:
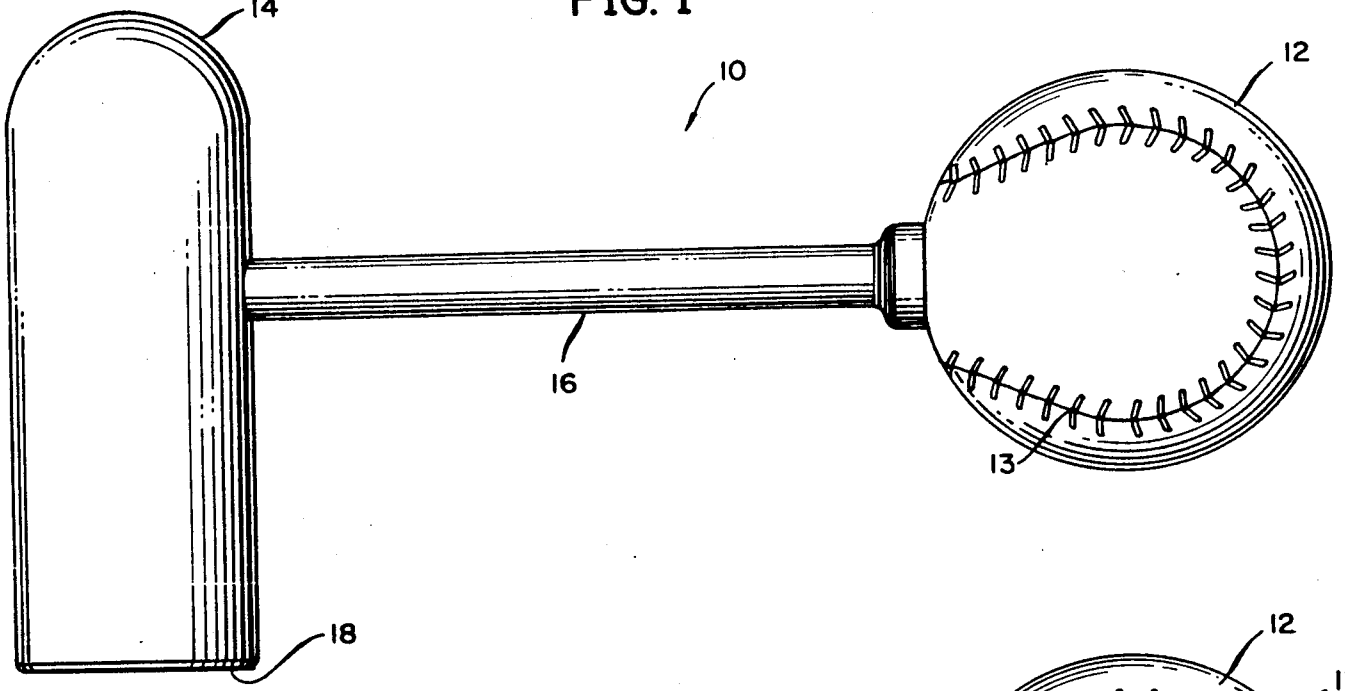
FIG. 1 is a side elevational view of the exercise apparatus.
Figure 2:
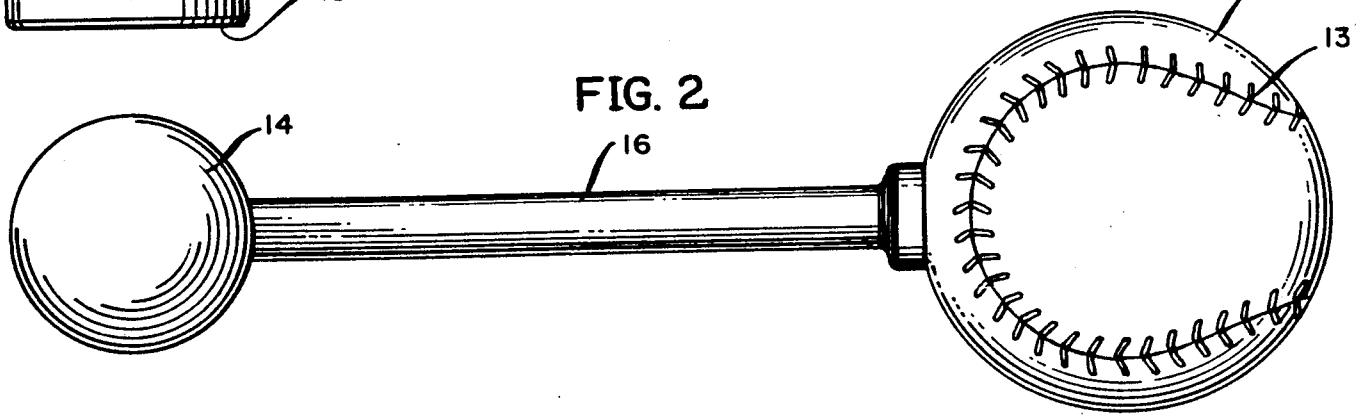
FIG. 2 is a top planer view of the exercise apparatus.

The exercise apparatus for baseball pitchers is illustrated in FIGS. 1 and 2 which are a side elevational view and a top planer view respectively. The exercise apparatus 10 is comprised of three basic elements; a standard regulation baseball 12, a weighted resistance 14 and a handle 16 interposed between the baseball 12 and the weighted resistance 14. As shown in FIGS. 1 and 2, the weighted resistance 14 is a one-piece weighted resistance resembling a hammerhead having a substantially flat striking surface 18. As will be described hereafter, the exercise device is designed to be utilized by gripping the baseball 12 with a normal pitching grip on the stitching pattern 13 and then manipulating the exercise apparatus in a hammer-like fashion using the pitching arm, to strike a frictionally resistant dowel or nail with the striking surface 18 of weighted resistance 14. This repetitive motion serves to strengthen the wrist, forearm and shoulder of the pitching arm as well as develop the necessary strength and callouses on the fingers of the pitching hand.

Figure 3:
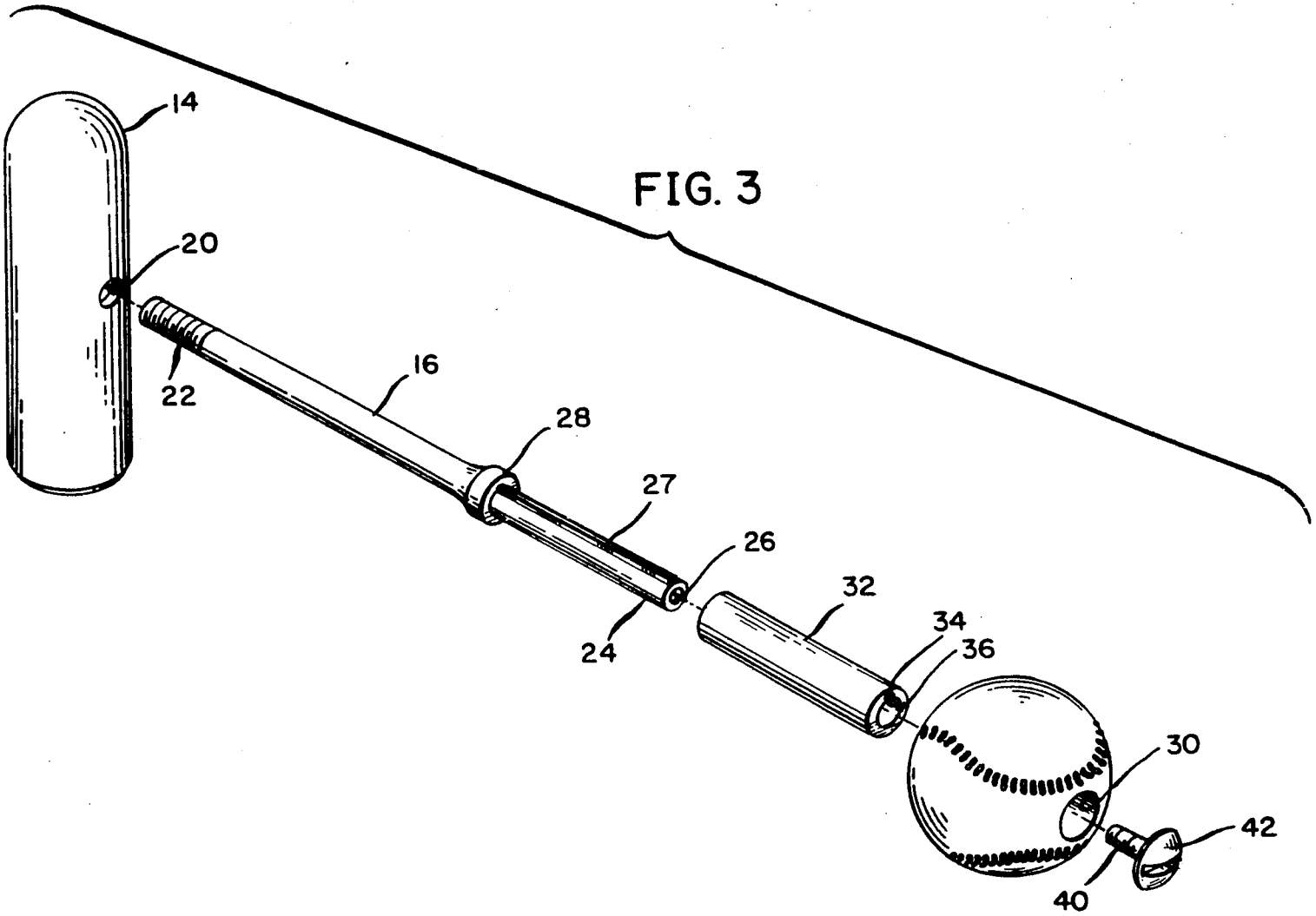
FIG. 3 is a perspective and exploded view of the apparatus.

A better understanding of the assembly of the exercise apparatus 10 may be had with reference to FIG. 3 which is an exploded, perspective illustration of the exercise apparatus 10. The embodiment disclosed in FIG. 3 illustrates that weighted resistance 14 is secured to handle 16 by means of a threaded bore 20 in weighted resistance 14 designed to accept threaded first end 22 of handle 16. This illustrates one embodiment of the manner in which the weighted resistance can be secured to handle 16. It will be recognized by those skilled in the art that there are a variety of alternate methods which may be utilized to secure weighted resistance 14 to handle 16 without deviating from the scope and sphere of this invention. The primary concern with respect to the securing of weighted resistance 14 to handle 16 is to ensure that it is adequately secured such that it will not release during the hammering motion which occurs during the utilization of the device.

Second end 24 of handle 16 has a threaded bore 26 positioned axially in its longitudinal end. Second end 24 of handle 16 also has a key 27 extending along handle 16 a distance approximately equal to the diameter of a standard regulation baseball. Second end 24 of handle 16 also has secured thereto, an annular stop 28 positioned such that the distance from stop 28 to the second longitudinal end 24 of handle 16 approximates a distance equal to the diameter of a standard baseball.

The regulation baseball 12 illustrated in FIG. 3 has an axial throughbore 30 passing therethrough. Throughbore 30 is of a diameter sufficient to allow acceptance of sleeve 32 as illustrated in FIG. 3. Sleeve 32 is cylindrical in shape having a cylindrical throughbore therethrough and having at least two key slots 34 and 36 on its internal cylindrical surface. Sleeve 32 is designed to be inserted into through bore 30 of baseball 12 and to then have a second end 24 of handle 16 inserted into sleeve 32, aligning key 27 on second end 24 of handle 16 with one of the key slots in sleeve 32. A threaded fastener 40 is then secured to threaded bore 26 on second end 24 of handle 16 after it has been inserted through baseball 12. Fastener 40 has a curved thin head 42 so as to adapt to the curvature of the spherical surface of baseball 12.

Figure 4B:
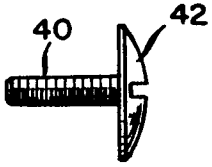
FIG. 4B is a partial side view of the exercise apparatus showing the manner in which the baseball is selectively secured.
Figure 4:
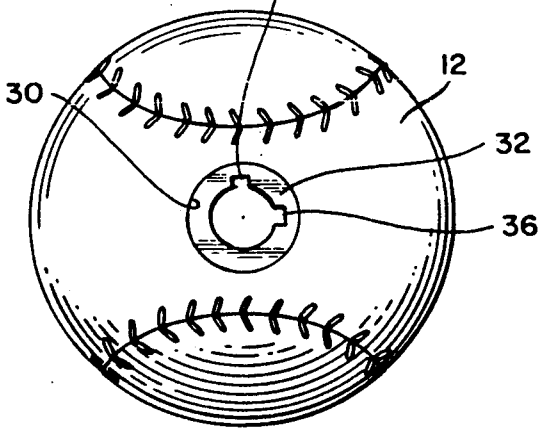
FIG. 4 is an end view of the exercise apparatus illustrating an embodiment of the manner in which the baseball is selectively secured to the exercise apparatus.
Figure 4A:
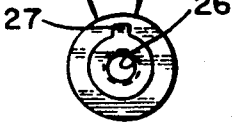
FIG. 4A is an end view of the handle of the exercise apparatus showing the manner in which it cooperates with the baseball.

A better understanding of the cooperation between handle 16, sleeve 32, baseball 12 and fastener 40 may be had by reference to FIGS. 4, 4A and 4B. FIG. 4 is an end view of baseball 12 showing throughbore 30 with sleeve 32 positioned therein. From this end view, key slots 34 and 36 are more evident. FIG. 4A is an end view of handle 16 as viewed from second end 24. Handle 16 has threaded bore 26 axially aligned in second end 24 and has a key 27 positioned on the outer cylindrical surface of second end 24. Key 27 extends from the terminal end of second end 24 of handle 16 to stop 28. Baseball 12 with sleeve 32 secured in throughbore 30 is then aligned with second end 24 of handle 16 such that key 27 aligns with one of the key slots 34 or 36 in sleeve 32 such that baseball 12 may be slidably secured to handle 16. Threaded fastener 40, as shown in FIG. 4B is then secured to threaded bore 26 to secure baseball 12 to handle 16. The frictional engagement between sleeve 32 and the walls of throughbore 30 is normally sufficient to prevent rotation of sleeve 32 about its axis. Additional resistance to rotation may be achieved by a number of means including adhesives between sleeve 32 and throughbore 30 or a key-slot cooperation between sleeve 32 and throughbore 30. This configuration allows the baseball 12 to be secured to handle 16 in a non-rotatable fashion so that it can be gripped by the user in performing the exercise motion hereinafter described.

Baseball pitchers use various grips in order to throw a variety of different types of pitches. The grips utilized are also governed by the stitch pattern on the baseball. Certain pitches are thrown with the forefinger and middle finger in alignment with the stitching and other pitches are thrown with the forefinger and middle finger perpendicular to the stitching. The utilization of multiple key slots in sleeve 32 and their positioning in sleeve 32 allows the user to slidably position the baseball on handle 16 such that the user can selectively align the stitching for the grip which he wishes to utilize. This alternative provided by this particular exercise apparatus affords the pitcher the opportunity to develop the necessary finger callouses for a particular type of pitch, which callouses he would normally develop over a period of weeks during spring training.

The embodiment disclosed in FIGS. 3, 4, 4A and 4B for slidably securing the baseball 12 to handle 16 is but one alternative means for preventing the rotation of the baseball about the axis of handle 16 and simultaneously allowing the user to position the stitching in the desired alignment. The prevention of the rotation of baseball 12 about the axis of handle 16 could also be accomplished by a throughbore, sleeve and handle assembly which was non-round which would prevent the rotation of baseball 12 about handle 16. Such configurations could include a second end 24 of handle 16 which was square in cross sectional area or triangular cross sectional area in cooperation with the sleeve which was similarly swquare or triangular in cross sectional area having a throughbore of a cross sectional area to accommodate second end 24 of handle 16.

Figure 5:
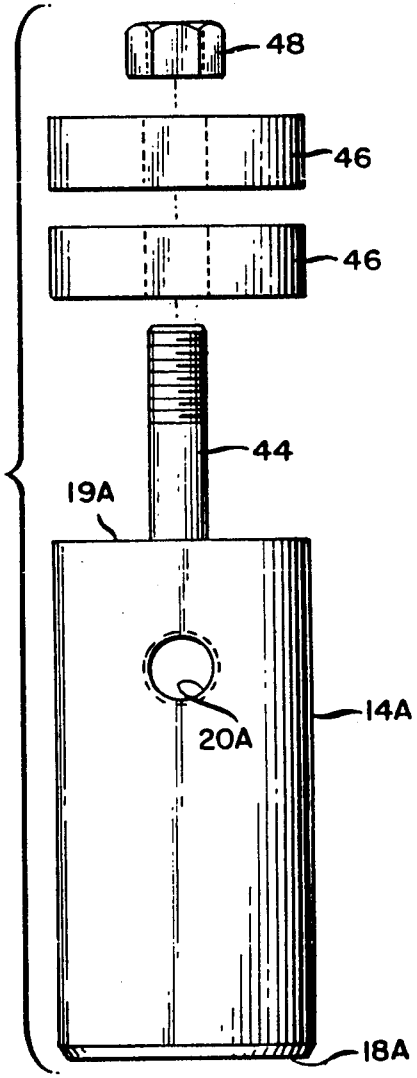
FIG. 5 is an illustration of an alternate embodiment of the resistance utilized on the exercise apparatus.

The embodiment of the exercise device disclosed thus far has utilized a weighted resistance 14 in the shape of a hammerhead which is removably secured to first end 22 of handle 16. Since people of all ages enjoy playing baseball, the exercise apparatus disclosed herein is adaptable for use by players of all ages. The older and more experienced player may wish to have a weighted resistance which may weigh substantially more than the weighted resistance appropriate for a yound child playing Little League. Therefore, multiple weighted resistances 14 would be interchangeable on handle 16. An alternative embodiment for weighted resistance 14 would be a weighted resistance of a fixed weight secured to handle 16 having the capability of adding additional weights to it. This embodiment is illustrated in FIG. 5 which is a front exploded view of a possible weighted resistance 14A which would have a receiving bore 20A for receipt of first end 22 of handle 16. Weight 14A would have a flat striking surface 18A and its opposing end 19A would have a post 44 extending therefrom, post 44 for the selective receipt of additional weights 46 which could be secured to post 44 by means of a threaded fastener 48 cooperating with threaded post 44. In this manner, the resistance could be increased or decreased at the desire of the user.

Figure 6:
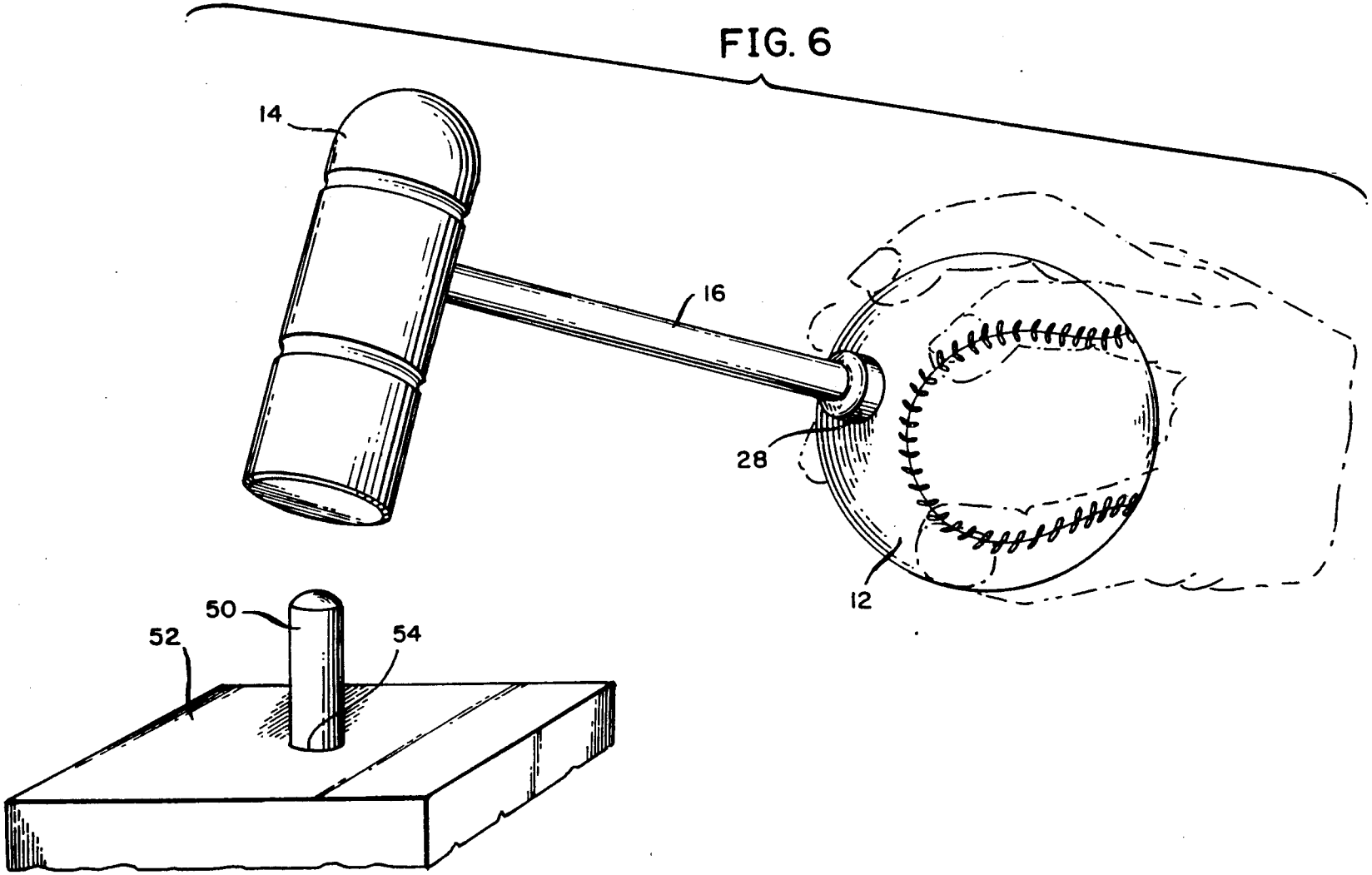
FIG. 6 is a perspective illustration of the use of the exercise apparatus.

FIG. 6 illustrates the actual use of the assembled apparatus. The baseball is gripped by the user with the preferred pitching grip and through the use of the shoulder, forearm, wrist and fingers, the user, using a hammer-like action, hits down upon a dowel 50 which is frictionally slidable within a base 52 having a throughbore 54 which provides resistance against dowel 50 and the hammering action of the user. The pitcher or user utilizing a hammer action, would repetitively strike the dowel, driving the dowel through throughbore 54. The user would then reset the dowel and repeat the exercise as many times as required or until becoming fatigued. The same action and benefits can be obtained by utilizing the exercise apparatus to drive nails into a piece of wood. In either instance, the pitcher or user is obtaining the benefit of utilizing his actual pitching grip in manipulating a weighted resistance utilizing his shoulder, forearm, wrist and fingers. This develops the strength required in these muscles for the pitching motion as well as developing the finger callouses required for repetitively pitching a baseball in competition.

While the present invention is directed towards an exercise apparatus specifically for baseball pitchers, it will be recognized that the apparatus has application as an exercise apparatus for general purposes and for utilization by non-baseball players. The exercise apparatus disclosed herein can be utilized by anyone wishing to strengthen the muscles of their arm, wrist and fingers and can be utilized to strengthen the muscles of the individual's weaker arm. For instance, a right-handed person could utilize the disclosed exercise device with his left hand to strengthen the muscles of the left arm and a left-hander could similarly utilize the exercise device to strengthen the muscles of the right arm. The apparatus, however, has particular application to baseball pitchers because of the unique cooperation between the weighted resistance and the actual baseball utilized as the gripping handle for the device.

It will be recognized by those skilled in the art that the apparatus has been described in connection with the exemplary embodiments thereof and it will be understood that many modifications will be apparent to those of ordinary skill in the art and this application is intended to cover any adaptations or variations thereof. Therefore, it is manifestly intended that this invention be only limited by the claims and equivalents thereof.

I claim:

1. An exercising apparatus for use by baseball players and, in particular, baseball pitchers for the strengthening of the pitching arm, said apparatus, when employed approximating a portion of the pitching or throwing motion, said apparatus comprising:

a rigid shaft having a first end and a second end; said first end of said rigid shaft including an attachment means and said second end of said rigid shaft comprising an engaging member;

a weighted resistance having a striking shaft, said sphere comprising a baseball having a stitched pattern thereon, said baseball having a througbore receiving a sleeve, said sleeve including an interlocking means for selectively receiving said engaging member of said shaft for non-rotatably securing said baseball to said engaging member of said shaft in one of a plurality of discrete positions about the axis of said shaft, said sphere to be gripped by the pitching hand of said player and manipulated in a hammer like motion striking said striking surface of said weighted resistance against a movable frictional resistance.

2. An apparatus in accordance with claim 1 wherein said second end of said shaft and said sleeve cooperate to permit the selective positioning of said baseball on said second end of said shaft so as to present a selective stitched pattern to said grip of said player.

3. An apparatus in accordance with claim 1 wherein said weighted resistance on said first end of said shaft is adjustable in weight.

4. A method for strengthening the forearm, wrist and fingers of a baseball pitcher's throwing arm by approximating a pitching motion against a resistance without releasing a baseball comprising:

a. securing a selective weight resistance means, having a striking surface to a first end of a rigid shaft, said shaft comprising a first end having an attachment means and a second end comprising an engaging member;

b. Securing a baseball having a stitched pattern thereon to said second end of said shaft, said baseball having a throughbore receiving a sleeve, said engaging member of said shaft for non-rotatably securing said baseball to said engaging member of said shaft in one of a plurality of discrete positions about the axis of said shaft;

c. gripping said baseball in a desired pitching grip;

d. manipulating said baseball, said rigid shaft and said weighted resistance in a hammer-like motion, striking said weighted resistance against a frictionally displaceable resistance;

e. repeating steps c through d.

* * * * *